United States Patent [19]

Klapp

[11] 3,932,982

[45] Jan. 20, 1976

[54] APPARATUS FOR PLACING FOLDED BOXES OR THE LIKE IN SHIPPING CARTONS

[75] Inventor: Hartmut Klapp, Kaarst, Germany

[73] Assignee: Jagenberg-Werke Aktiengesellschaft, Duesseldorf, Germany

[22] Filed: Nov. 28, 1973

[21] Appl. No.: 419,843

[30] Foreign Application Priority Data

Dec. 15, 1972 Germany ..... 2261416

[52] U.S. Cl. ..... 53/244; 53/259; 214/7; 271/184; 271/215

[51] Int. Cl.[2] ..... B65B 5/10; B65B 35/24

[58] Field of Search.....53/35, 159, 160, 244, 249–251, 53/259; 93/93 DP; 214/7; 271/69, 177, 178, 181, 184, 185, 198, 214,215

[56] References Cited

UNITED STATES PATENTS

| | | | |
|---|---|---|---|
| 2,233,850 | 3/1941 | Rapley | 93/93 DP |
| 2,815,210 | 12/1957 | Weber et al. | 271/185 X |
| 2,853,298 | 9/1958 | Faeber | 271/214 X |
| 3,289,230 | 12/1966 | Detert | 53/244 X |
| 3,354,613 | 11/1967 | Anderson et al. | 53/251 |
| 3,359,874 | 12/1967 | Stegenga et al. | 214/7 X |
| 3,425,184 | 2/1969 | Heliot | 53/251 X |
| 3,601,952 | 8/1971 | Cato | 53/160 X |
| 3,606,311 | 9/1971 | Yoshimura | 271/177 |

*Primary Examiner*—Robert L. Spruill
*Attorney, Agent, or Firm*—Burgess, Dinklage & Sprung

[57] ABSTRACT

A method for filling a shipping carton with flat-folded boxes supplied in substantially horizontal shingled array from a processing machine, comprising positioning an empty carton in displaceable manner on a support below the supply from said processing machine, supporting said boxes in shingled array while advancing them along a curved path to substantially vertical shingled array, discharging said vertically shingled boxes successively into said carton, and supporting said discharged boxes on one flat surface thereof within said carton, whereby the force of said boxes as discharged causes said carton to be displaced on its support. The apparatus includes a pair of cooperating curved conveyors extending from said manufacturing machine conveyor to said carton, whereby said boxes are transferred from horizontal shingled array to vertical shingled array and are successively discharged into said carton in vertical disposition. A pulley about which one of the curved conveyors is trained, in operative position is disposed within said carton so that successively discharged boxes, with said pulley as a back stop, cause said carton to advance on its support. When the carton is filled, the pulley and its conveyor are raised, the carton is removed and replaced by an empty carton and the process is repeated.

3 Claims, 2 Drawing Figures

APPARATUS FOR PLACING FOLDED BOXES OR THE LIKE IN SHIPPING CARTONS

Figure 1:
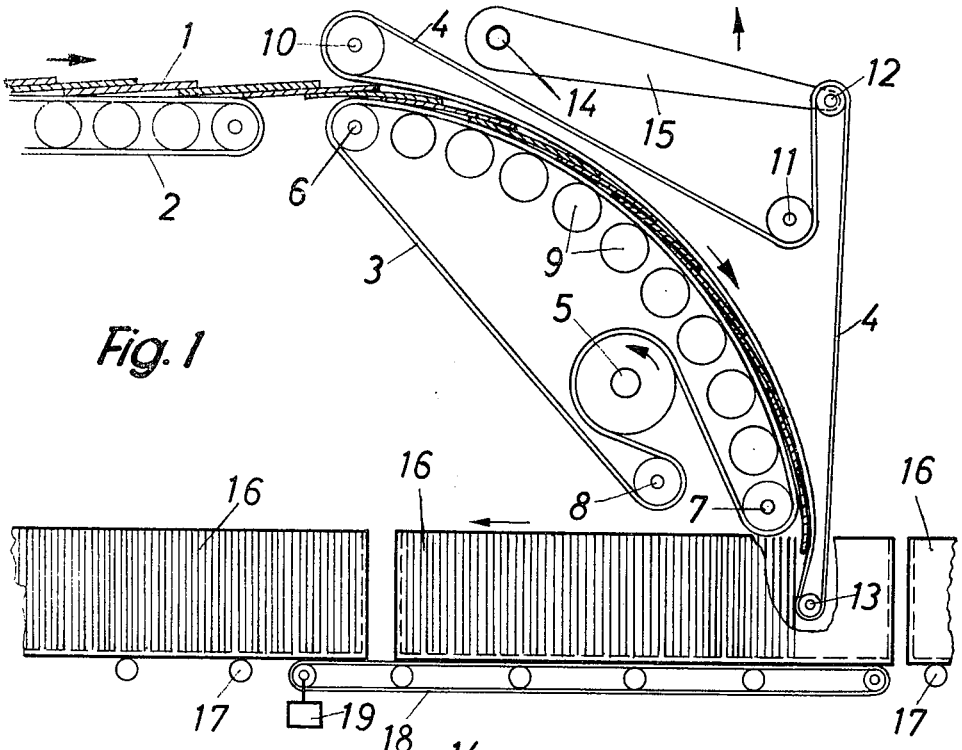

The invention relates to a method of placing folded boxes or the like, which are put out by a box making or processing machine in shingled array, and additionally the invention relates to an apparatus for the practice of the method.

In the manufacture of folding boxes in high-output machines the carrying off of the folded boxes leaving the gluing machine has involved relatively great manpower. It has hitherto been customary for several persons to grasp groups of the folded boxes delivered in shingled array on the conveyor belt coming from the gluing machine, place them in a bundling machine for the application of a bundling wrapper, and then place them in bundled stacks of, for example, 50 boxes into shipping containers. The transport and storage of folded boxes in bundled form have proven to be disadvantageous insofar as the tight pressure of the stacked boxes on one another has led to trouble in the mechanical erection of the boxes in packing or cartoning machines.

To avoid these disadvantages, the folded boxes have been removed from the carrying off conveyor of the gluing machine and have been placed by hand into prepared shipping cartons having a capacity of approximately 500 boxes, the boxes being transported and stored upright in the cartons without compression. These procedures, however, cannot be handled successfully by only a single operator since attention must also be paid to uniformity in the count of the folded boxes being placed in the shipping cartons.

Automatically operating machines are also known for packing shipping cartons with folded boxes leaving a gluing machine. Such machines are expensive, however, because the shingled boxes are separated and placed on an intermediate stack from which they are taken and placed in the shipping carton by means of special devices, or else the boxes are separated, after intermediate stacking, and successively placed in the shipping carton. In this method the advance of the shipping carton requires a separate drive, and the matching of the speed of advance to the folded box feed sequence presents appreciable difficulty.

It is an object of the present invention to avoid the disadvantages of the prior art systems and to provide an apparatus characterized by low cost, simplicity of control by the operator and trouble-free operation.

These and other objects and advantages are realized in accordance with the present invention pursuant to which there is provided a method for filling a shipping carton with flat-folded boxes supplied in substantially horizontal shingled array from a processing machine, comprising positioning an empty carton in displaceable manner on a support below the supply from said processing machine, supporting said boxes in shingled array while advancing them along a curved path to substantially vertical shingled array, discharging said vertically shingled boxes successively into said carton and supporting said discharged boxes on one flat surface thereof within said carton, whereby the force of said boxes as discharged causes said carton to be displaced on its support.

The invention also provides an apparatus for carrying out the process comprising means for supporting said carton positioned below said manufacturing machine conveyor, and a pair of cooperating curved conveyors extending from said manufacturing machine conveyor to said carton, whereby said boxes are transferred from horizontal shingled array to vertical shingled array and are successively discharged into said carton in vertical disposition.

One of the curved conveyors is trained about a pair of displaceable pulleys, one of the pulleys in operative position being disposed in said carton to form a back stop for one flat surface of discharged boxes, thereby to cause said carton to advance a non-driven conveyor on which it is supported.

The curved belt consists of a driven lower belt and a non-driven upper belt, the effective length of the upper belt being variable in the area of its free end by the displacement of pulleys.

The conveyor means which accommodates the shipping carton and which is constructed in the form of a non-driven roller conveyor or slide has associated with it a braking member acting on the shipping carton, its action on the carton being variable in accordance with the desired full density.

The advantages achieved with this invention lie primarily in the fact that the flat-folded boxes leaving the folding-box gluing machine in a shingled array are delivered into the automatically advancing shipping carton without being singled out and without intermediate stacking.

Figure 2:
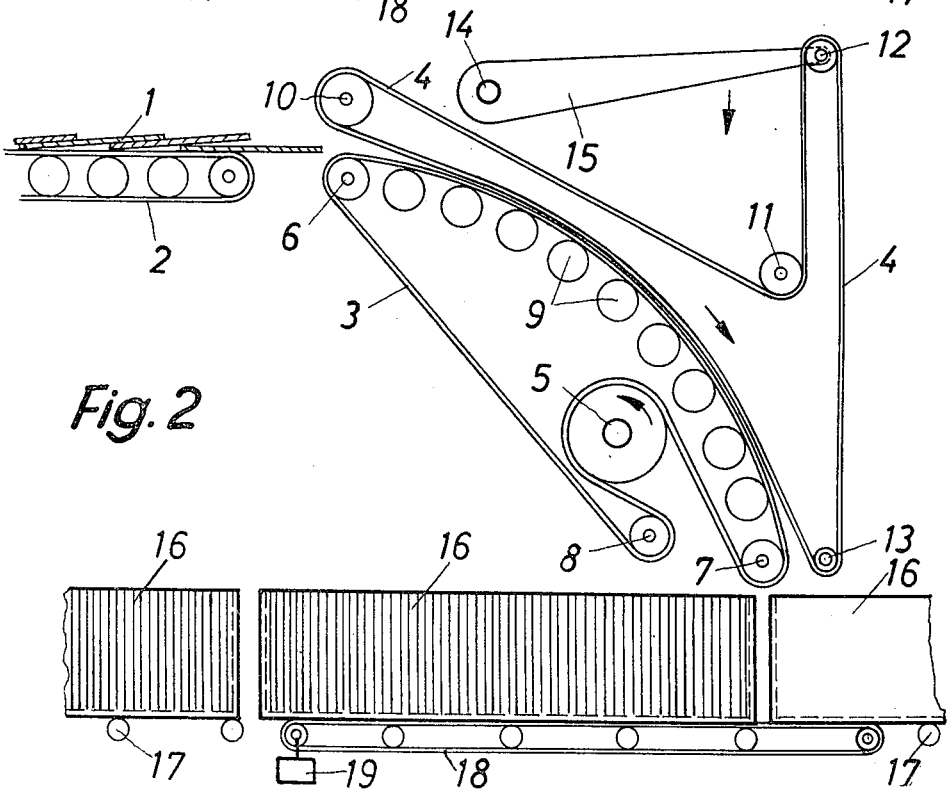

The invention will be further described with reference to the accompanying drawing, wherein:

FIG. 1 is a diagrammatic representation of the apparatus during the carton filling process, and FIG. 2 shows the apparatus in position between filling actions.

Referring now more particularly to the drawing, the flat-folded boxes 1, in a shingled array as they leave a folding-box gluing machine, pass over a connecting conveyor 2 into the entrance area of a belt conveyor consisting of a lower belt 3 and an upper belt 4. The lower belt 3 passes around a drive pulley 5, and guide pulleys 6, 7 and 8, and is supported in the area between pulleys 6 and 7 by supporting rolls 9 which define a curved conveyor path.

The upper belt 4 is guided around pulleys 10, 11, 12 and 13, of which pulleys 10 and 11 rotate about stationary axes while pulleys 12 and 13 and thus the free end of belt 4 are vertically displaceable. This displaceability is achieved by mounting pulley 12 on a lever 15 which can pivot about a stationary fulcrum 14.

The shipping cartons 16 which are being filled are on a non-driven roller conveyor 17 and as their filling progresses they are advanced by the pressure of the folded boxes 1 which enter it and are back-stopped by the belt 4. In the areas of the filling station the shipping carton 16 rests upon a conveyor belt 18 which passes around a group of the non-driven rollers of roller conveyor 17. An adjustable braking member 19 of any desired kind acts upon one or more of the rollers around which conveyor belt 18 passes, and in this manner the fill density of the shipping carton 16 may be controlled.

To switch the apparatus, after the filling of shipping carton 16, to the following shipping carton, the connecting conveyor 2 is briefly stopped shortly before the end of the filling action and the folded boxes that are still within the belt conveyor 3–4 are delivered into the shipping carton 16. Then, by the actuation of lever 15, the free end of belt 14 is lifted out of shipping carton 16 and the next shipping carton is brought into the fill position so that, when the connecting conveyor 2 has been reactuated and the conveyor belt 4 has again been lowered, another filling operation can be initiated.

It will be appreciated that the instant specification and examples are set forth by way of illustration and not limitation, and that various modifications and changes may be made without departing from the spirit and scope of the present invention.

I claim:

1. An apparatus for filling a shipping carton with flat-folded boxes as put out in shingled array by a generally horizontal conveyor of a manufacturing or processing meachine, comprising a conveyor for supporting said carton and positioned below said manufacturing machine conveyor, a pair of cooperating curved conveyors extending from said manufacturing machine conveyor to said carton, a portion of one of said curved conveyors in operative position extending into said carton and bearing against one flat surface of boxes within said carton, whereby said boxes are transferred from horizontal shingled array to vertical shingled array and are successively discharged into said carton in vertical disposition, successive boxes discharged into said carton causing said carton to advance on its conveyor, and means for displacing said portion of said one curved conveyor between operative position in said carton and inoperative position above said carton, whereby when said carton is filled actuation of said displacing means to displace said portion into inoperative position permits said filled carton to be removed from below said curved conveyors and to be replaced by an empty carton, whereafter said displacing means may be again actuated to restore said portion to operative position.

2. An apparatus according to claim 1, wherein that one of said curved conveyors extending into said carton includes a pair of pulleys about which it is trained, one of said pulleys in operative position extending into said carton to cause said portion of said one conveyor to extend into said carton, both of said pulleys being displaceable, said means for displacing said portion comprising a lever for displacing said pulleys and thereby to raise said one pulley and its associated curved conveyor portion out of said carton into inoperative position.

3. An apparatus according to claim 1, including adjustable braking means for said non-driven conveyor, whereby the resistance to advance of said non-driven conveyor can be adjusted, thereby to adjust the fill density of said carton.

* * * * *

UNITED STATES PATENT OFFICE

CERTIFICATE OF CORRECTION

Patent No. 3,932,982 Dated Janiary 20, 1976

Inventor(s) Hartmut Klapp

It is certified that error appears in the above-identified patent and that said Letters Patent are hereby corrected as shown below:

Column 2, line 22, "full" should read -- fill --.

Column 4, line 22, cancel "non-driven".

Column 4, line 23, cancel "non-driven".

Signed and Sealed this

Fifth Day of October 1976

[SEAL]

*Attest:*

RUTH C. MASON
*Attesting Officer*

C. MARSHALL DANN
*Commissioner of Patents and Trademarks*